US008955477B2

(12) United States Patent
Busse

(10) Patent No.: US 8,955,477 B2
(45) Date of Patent: Feb. 17, 2015

(54) CAMSHAFT ADJUSTER FOR AN INTERNAL COMBUSTION ENGINE

(75) Inventor: Michael Busse, Herzogenaurach (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 350 days.

(21) Appl. No.: 13/294,268

(22) Filed: Nov. 11, 2011

(65) Prior Publication Data

US 2012/0118252 A1 May 17, 2012

(30) Foreign Application Priority Data

Nov. 11, 2010 (DE) ..... 10 2010 051 054

(51) Int. Cl.
*F01L 1/34* (2006.01)
*F01L 1/344* (2006.01)

(52) U.S. Cl.
CPC ..... *F01L 1/3442* (2013.01); *F01L 2001/34423* (2013.01); *F01L 2001/34426* (2013.01); *F01L 2001/3443* (2013.01); *F01L 2001/34453* (2013.01); *F01L 2001/34463* (2013.01); *F01L 2800/01* (2013.01)
USPC ..... 123/90.17; 123/90.12

(58) Field of Classification Search
USPC ..... 123/90.12, 90.13, 90.15, 90.17, 90.33, 123/90.34; 464/160, 161
See application file for complete search history.

(56) References Cited

U.S. PATENT DOCUMENTS

| | | | | |
|---|---|---|---|---|
| 6,330,870 | B1 * | 12/2001 | Inoue et al. | 123/90.17 |
| 7,363,898 | B2 * | 4/2008 | Suzuki et al. | 123/90.17 |
| 2007/0215084 | A1 * | 9/2007 | Pluta et al. | 123/90.17 |
| 2009/0145385 | A1 | 6/2009 | Noguchi | |
| 2011/0139100 | A1 | 6/2011 | Busse | |

FOREIGN PATENT DOCUMENTS

| | | | |
|---|---|---|---|
| DE | 10 2008 011 916 | A1 | 9/2009 |
| DE | 10 2008 036 877 | A1 | 2/2010 |

* cited by examiner

*Primary Examiner* — Thomas Denion
*Assistant Examiner* — Daniel Bernstein
(74) *Attorney, Agent, or Firm* — Davidson, Davidson & Kappel, LLC

(57) ABSTRACT

A camshaft adjuster which has a control valve and at least one pressure-controlled positioning valve which is connected to a pair of control chambers. The control chambers each have an early chamber and a late chamber and one of the control chambers is designed in such a manner that, in an unenergized basic position of the control valve, in order to set a middle position, the smaller of the early and late chambers of the one of the control chambers is connected to a supply line and the larger of the early and late chambers of the one of the control chambers is connected to a removal line.

15 Claims, 3 Drawing Sheets

CAMSHAFT ADJUSTER FOR AN INTERNAL COMBUSTION ENGINE

CROSS-REFERENCE TO RELATED APPLICATION

This application claims the priority of DE 10 2010 051 054.8 filed Nov. 11, 2010, which is incorporated by reference herein.

FIELD OF THE INVENTION

The invention relates to a camshaft adjuster for an internal combustion engine,

BACKGROUND OF THE INVENTION

In internal combustion engines, in particular in petrol-operated motor vehicle engines, camshafts are used to actuate the "gas exchange valves." The cams of the camshafts conventionally bear against cam followers, for example bucket tappets, rocker arms or oscillating levers. If a camshaft is transferred into rotation, the cams roll along the cam followers which, in turn, actuate the gas exchange valves. The opening duration and the opening amplitude, but also the opening and closing times of the gas exchange valves are therefore defined by the position and the shape of the cams.

The angular displacement of the camshaft with respect to a crankshaft in order to obtain optimized control times for various rotational speed and load states is referred to as camshaft adjustment. One structural alternative of a camshaft adjuster operates, for example, according to the "pivoting motor principle." In this case, there is a stator and a rotor which lie coaxially with respect to each other and are movable relative to each other. The stator and the rotor together form hydraulic chambers, which are simply referred to in the following as chambers. One pair of chambers here is in each case delimited by webs of the stator and is divided by a respective vane of the rotor into two mutually opposed chambers, the volumes of which are changed in an opposed manner by a rotational movement of the rotor relative to the stator. In the maximum position of adjustment, the respective vane bears against one of the webs at the edge of the stator.

The relative rotational movement of the rotor takes place by means of adjustment of the vane by a hydraulic medium, for example oil, being introduced into the chambers via radial channels and pushing the vane away. With the adjustment of the rotor, the camshaft, which is fastened to the rotor, is adjusted, for example, in the early direction, i.e. to an earlier opening time of the gas exchange valves. With adjustment of the rotor in the opposite direction, the camshaft is adjusted in the late direction in relation to the crankshaft, i.e. to a later opening time of the gas exchange valves.

The camshaft adjuster is controlled by an electronic control device which, on the basis of electronically recorded characteristic data of the internal combustion engine, for example rotational speed and load, regulates the inflow and outflow of pressure medium to and from the individual chambers via a control valve which is designed, for example, as a proportional valve.

In the event of an insufficient supply of pressure medium, as is the case, for example, during the starting phase of the internal combustion engine or during idling, alternating torques which are transmitted by the camshaft to the rotor lead to the rotor being moved in an uncontrolled manner, which has the consequence that the vanes beat to and fro within the working spaces, which promotes the wear and causes an undesirable production of noise. In addition, the phase position fluctuates greatly between crankshaft and camshaft, and therefore the internal combustion engine does not start or runs noisily. In order to avoid this problem, hydraulic camshaft adjusters are equipped with a locking mechanism for locking stator and rotor for conjoint rotation. A locking mechanism of this type comprises, for example, an axial pin which is accommodated in the rotor, is displaced out of the receptacle thereof in the axial direction by means of a spring and can engage in a form-fitting manner in a locking slotted guide which is formed, in particular, in a sealing cover for the stator and the rotor. For unlocking, the pin is acted upon on the end side by pressure medium and displaced back into the receptacle thereof in the rotor.

The stator and rotor are locked in a camshaft phase position which is referred to as the basic position and is thermodynamically favorable for starting the internal combustion engine. Depending on the specific design of the internal combustion engine, an early position, late position or intermediate position is selected as the basic position. With reference to the driving direction of the stator or camshaft, the late position corresponds to an end rotational position of the rotor in the trailing direction (in which the volumes of the advancing pressure chambers are at maximum), the early position corresponds to an end rotational position of the rotor in the advancing direction (in which the volumes of the trailing chambers are at maximum), and the intermediate position corresponds to a phase position located between the early and the late position. An intermediate position located at least approximately in the middle between the early and the late position is referred to as the middle position. An adjustment of the phase position of the rotor in a rotational direction identical to the driving direction of the stator or camshaft is referred to as early adjustment. An adjustment of the phase position of the rotor in a rotational direction opposed thereto is referred to as late adjustment.

If, when the internal combustion engine is turned off, the basic position is not reached (for example, in the event of the motor stalling), the rotor is automatically adjusted into the late position owing to moments of friction. If the rotor is intended to be locked in the early position or an intermediate position, special measures by means of which the rotor is adjusted relative to the stator therefore have to be taken. For example, torsion springs are provided for this purpose in conventional camshaft adjusters, the torsion springs prestressing the rotor in the direction of the desired basic position. In a concept for the locking of stator and rotor, the latter are already locked during the turning off of the motor. This affords the advantage that, during the subsequent starting of the motor, the motor is started directly in the middle position. However, this is associated with a large outlay on control and monitoring, since the control valve has to be strategically energized in accordance with the current angular position when the motor is turned off and the angular position has to be constantly monitored.

DE 10 2008 011 916, for example, describes a camshaft adjuster with an axial multiple grid-type locking means. However, a disadvantage of this camshaft adjuster is that it functions only if there is no oil pressure in the early chamber.

SUMMARY OF THE INVENTION

The invention is based on the object of reducing the complexity for locking a camshaft adjuster in the middle position irrespective of the angular position of the rotor with respect to the stator when switching off the internal combustion engine.

The object is achieved according to the invention by a camshaft adjuster for an internal combustion engine, in particular for a motor, which comprises:

a stator which can be driven by a crankshaft of an internal combustion engine and is located radially on the outside, a rotor which can be connected to a camshaft for conjoint rotation and is located radially on the inside, pairs of chambers arranged between the rotor and the stator, comprising in each case two opposed chambers, namely an early chamber and a late chamber, which can be acted upon with a pressure medium in such a manner that the rotational position of the rotor relative to the stator can be changed, a control valve which is part of the pressure medium circuit and is provided for regulating the inflow and outflow of pressure medium to and from the chambers, wherein the control valve has a pressure medium port for supplying the pressure medium and a tank port for removing the pressure medium, and at least one pressure-controlled positioning valve which is connected to a pair of control chambers, comprising two control chambers, and which is designed in such a manner that, in an unenergized basic position of the control valve, in order to set a middle position the smaller control chamber is connected to a supply line and the larger control chamber is connected to a removal line.

Control chambers or a pair of control chambers refers here to the two opposed chambers, the pressure medium circuit of which is activated by the positioning valve in the basic position of the control valve, i.e. when the motor is switched off. All of the other pairs of chambers are called "further pairs of chambers" below.

The positioning valve is connected to the control valve and therefore constitutes a branch of the pressure medium circuit of the camshaft adjuster. In this case, the positioning valve is in particular switched on only if the control valve has taken up the basic position thereof.

Tank port refers to that port of the control valve via which the pressure medium is returned from the camshaft adjuster to a tank of the lubricating oil circuit of the motor. The term "tank" therefore stands for removal of the pressure medium outside the camshaft adjuster.

The invention is based on the concept, in the basic position of the motor and of the control valve, in which the control valve is not energized, of transferring the camshaft adjuster via a suitable distribution of pressure medium into the middle position, which is particularly advantageous for a renewed starting of the internal combustion engine, only by means of the pair of control chambers. For this purpose, the control chambers of the pair of control chambers are connected separately from the further pairs of chambers, via the pressure-controlled positioning valve arranged in the camshaft adjuster, to the pressure medium circuit in the camshaft adjuster. If the vanes of the rotor are not located in the middle position when the motor is turned off, the chambers of each pair of chambers differ in size. If, for example, the vanes come to a standstill between an early end stop and the middle position, the early chambers are smaller than the late chambers. Conversely, if the vanes are closer to the respective late end stop, the late chambers are smaller. The positioning valve is therefore set in such a manner that, in the basic position of the control valve, the control chamber which, when the motor is switched off, is smaller than the opposed control chamber is connected to a feed line of the pressure medium circuit and is therefore filled with pressure medium. The other control chamber which, when the motor is switched off, has the larger volume is connected to the removal line, and therefore a process of emptying said control chamber begins. During filling of the smaller control chamber and emptying of the larger control chamber, the vane is pushed away between the two control chambers and, after a short time, reaches the middle position in which the locking mechanism is activated, in particular by a pin of the locking mechanism engaging axially in a slotted guide and fixing the rotor in a form-fitting manner in relation to the stator.

The above-described operations permit locking of the camshaft adjuster without the current angular position of the rotor in relation to the stator having to be determined. Instead, what is referred to as a "forced control" is provided. The forced control is integrated in the camshaft adjuster and is automatically activated after the internal combustion engine has been switched off. The rotor vane arranged between the two control chambers is displaced in the direction of the middle position on account of the compressive force of the pressure medium in the control chamber of increasing size, as a result of which a rotation of the rotor in relation to the rotationally fixed stator is triggered. This rotation is interrupted in the middle position, since the locking takes place automatically there.

According to a preferred refinement, the camshaft adjuster comprises at least one sealing cover which laterally delimits the chambers and bears against the stator and the rotor, wherein the positioning valve communicates in terms of flow with grooves which are formed in the sealing cover and can be connected to the pressure medium circuit via bores in the rotor. Both the supply line and the removal line open out into the grooves in the sealing cover. In addition, the bores in the rotor also open out in the grooves. The pressure medium is supplied to or removed from the grooves via said bores, which are connected to the pressure medium circuit. During rotation of the rotor, the path of the bores overlaps various grooves formed consecutively in the encircling direction. The grooves and, correspondingly, the control chambers to/from which pressure medium is supplied and removed therefore depend on the position of the rotor. Owing to the grooves, the operation to lock the camshaft adjuster is assisted, in a wear-reducing manner, by the rotor additionally being braked in the middle position by means of overlapping the grooves, which leads to a reduction in the chamber pressure, and therefore the pin has sufficient time to enter the slotted guide. In particular, only a single pin is provided in this case, since the risk of the pin traveling over the locking position and not being able to engage in the slotted guide in good time is minimized. In addition, this causes less wear to the pin and to the slotted guide.

According to a further preferred refinement, in the basic position of the control valve, the smaller of the two control chambers is connected via the positioning valve and via a first groove in the sealing cover, which groove is connected to the pressure medium port of the control valve, and the larger control chamber is connected via the positioning valve to a second groove in the sealing cover, which groove is designed for returning the pressure medium into a tank of the pressure medium circuit. Pressure medium is introduced via the pressure medium port of the control valve into the first groove and subsequently into the smaller control chamber. At the same time, the pressure medium in the larger control chamber flows via the removal line to the second groove. Since the second groove is connected to the tank, the oil flows in the process out of the camshaft adjuster.

The camshaft adjuster comprises the locking mechanism, by means of which, in the middle position, the rotor and the stator are connected to each other for conjoint rotation, wherein the control valve is connected preferably via a pressure line to the locking mechanism. The pressurization of the pin is therefore coupled to the position of the control valve. So that the pin, when passing over the middle position, can engage unhindered in the slotted guide in the sealing cover, in the basic position of the control valve, the pressure line is preferably connected to the tank port of the control valve, and therefore the pin is no longer acted upon by the pressure medium. In all further positions of the control valve, the pressure line to the locking mechanism is always connected to the pressure medium port on the control valve, as a result of which the pin is pressed back axially and cannot produce a form-fitting connection with the slotted guide.

According to a preferred alternative, the positioning valve is connected to the pressure line and has two positions which can be set depending on whether the pressure line is connected to the pressure medium port or to the tank port. If the pressure line is connected to the tank port, neither the pin nor the positioning valve is subjected to any compressive force of the pressure medium. In this first position of the positioning valve, which is referred to as the ON position, the smaller of the control chambers is, as already described, connected via the supply line to the pressure medium port of the control valve and the larger control chamber is at the same time emptied via the removal line. If, however, the control valve is not in the basic position thereof, pressure medium is fed into the pressure line, the pressure medium pushing the pin back and at the same time transferring the positioning valve into a second position, the OFF position. In the OFF position of the positioning valve, the early control chamber is short-circuited to the further early chambers in the camshaft adjuster, and the late control chamber is likewise short-circuited to the further late chambers.

Furthermore, it is advantageous that, in the basic position, the opposed chambers of the further pairs of chambers are short-circuited. The pressure in every two opposed chambers is equalized by the short-circuiting of the pairs of chambers, this aiding displacement of the rotor by the pressure acting on the vane in the region of the pair of control chambers.

The control valve is preferably a 5/4-way directional control valve and is connected via a first port to the late chambers of the further pairs of chambers, via a second port to the early chambers of the further pairs of chambers and via a third port via the pressure line to the locking mechanism, wherein the supply line is a branch of the line to the early chambers.

According to a preferred variant embodiment, the positioning valve is a 6/2-way directional control valve and communicates with the two control chambers via two ports. In this case, each positioning valve has two inputs and two outputs. If the motor is switched off and the positioning valve is in the ON position, the supply line and the removal line open into two of the ports, which are referred to as inputs. The short circuit between the opposed chambers of the further pairs of chambers is produced here by two other inputs of the positioning valve. In the second position of the positioning valve, the early chamber of the control chamber pairing is connected to the other early control chambers and the late control chamber is connected to the other late chambers. The other two inputs of the positioning valve are not used in this case.

According to an alternative, preferred variant embodiment, the positioning valve is of two-part design and comprises two 4/2-way positioning valves, wherein, in the basic position of the control valve, the control chambers are connected to the supply line and to the removal line via respective positioning valves. Each of said two positioning valves is likewise an ON/OFF valve which is actuated by the pressure medium in the pressure line. In the OFF position, the two positioning valves are set up to short-circuit the early and the late chambers of the control chamber pairing to the early and late chambers, respectively, of the further pairs of chambers.

BRIEF DESCRIPTION OF THE DRAWINGS

Exemplary embodiments of the drawing are explained in more detail with reference to a drawing, in which, schematically and greatly simplified.

The same reference numbers have the same meaning in the various figures.

DETAILED DESCRIPTION OF THE INVENTION

Figure 1:
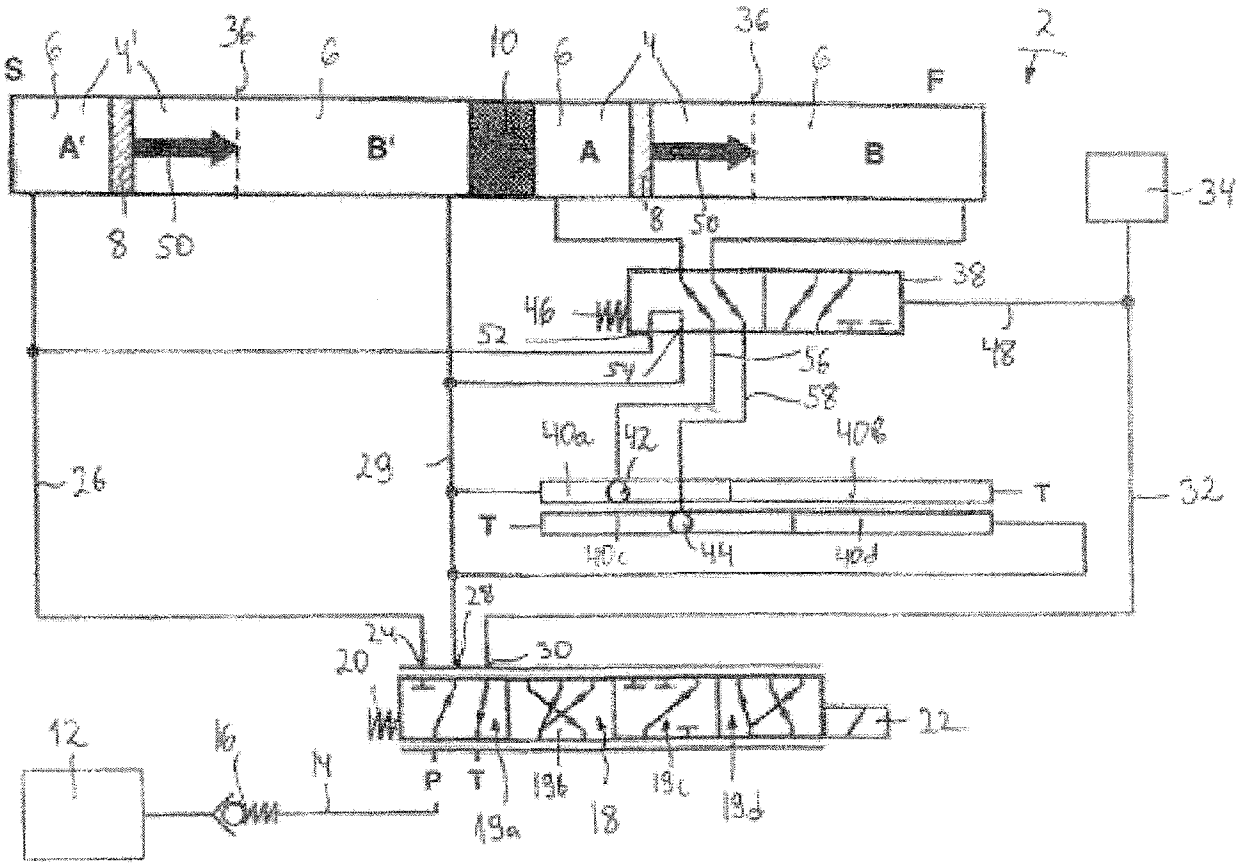
FIG. 1 shows an adjustment of a camshaft adjuster according to a first variant embodiment from "late" in the direction of "early" as far as a middle position.
Figure 2:
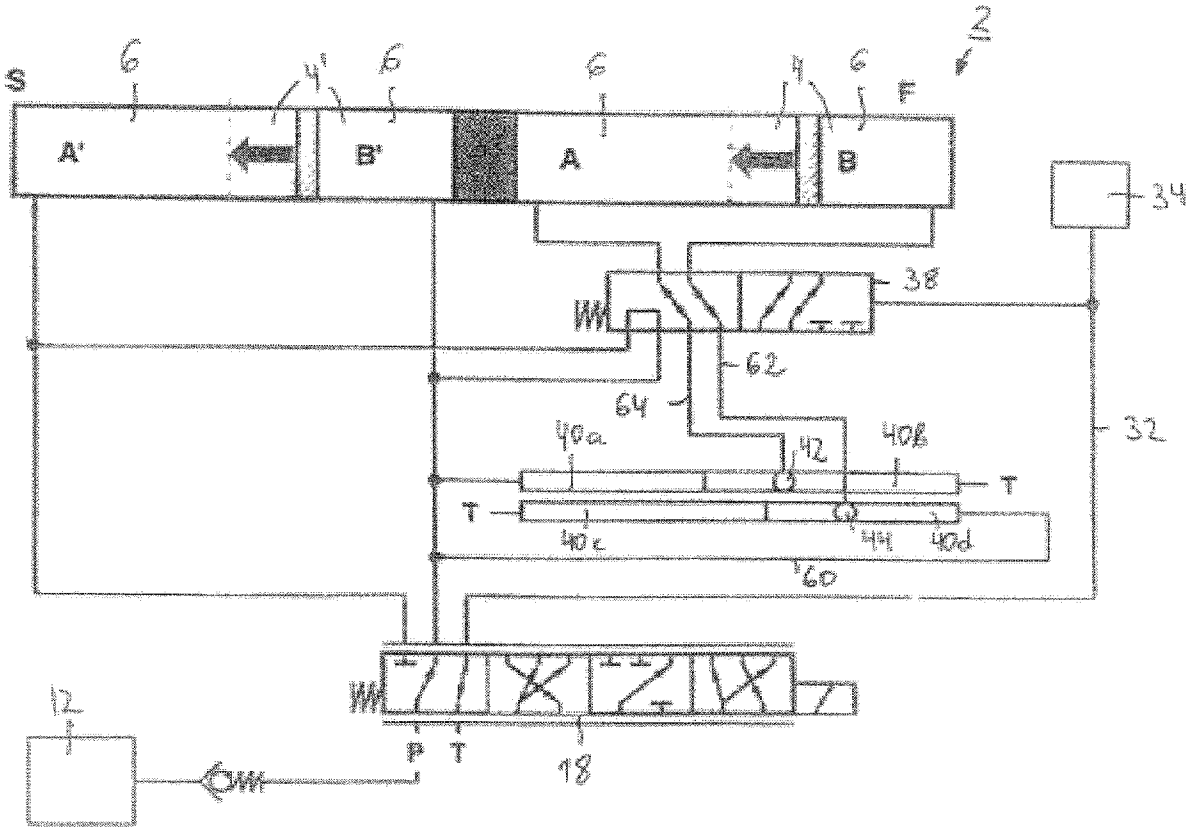
FIG. 2 shows the adjustment of the camshaft adjuster according to FIG. 1 from "early" in the direction of "late" as far as the middle position.

FIG. 1 and FIG. 2 illustrate a first variant embodiment of a camshaft adjuster 2 for an internal combustion engine (not shown specifically here) which, in particular, is a motor. The camshaft adjuster 2 comprises a stator and rotor (likewise not shown specifically), between which a plurality of chambers 6 grouped into pairs of chambers 4, 4' are formed. Each of the pairs of chambers comprises an early chamber B, B' arranged on the right in the figures and a late chamber A, A' arranged on the left. The chambers 6 of each pair of chambers 4, 4' are separated from each other by an adjustable vane 8 of the rotor. The pairs of chambers 4, 4' are delimited in the circumferential direction by webs 10 of the stator. On the side of the earlier chambers B, B', the webs 10 form an early end stop F, and, on the side of the late chambers A, A', said webs form a late end stop S.

The camshaft adjuster 2 is a hydraulic camshaft adjuster, in which the rotor is adjusted in relation to the stator with the aid of a pressure medium, in particular an oil. The oil of a lubricating circuit 12 of the motor is used as the pressure medium. The oil is conducted to a control valve 18 of the camshaft adjuster 2 via a lubricating oil line 14, in which a nonreturn valve 16 is integrated. In the exemplary embodiment shown, the control valve 18 is a 5/4-way directional control valve, i.e. the valve has five ports and can take up four positions 19*a*, 19*b*, 19*c*, 19*d*. In the unenergized state, when the motor is switched off, the control valve 18 is held in a basic position 19*a* by a restoring spring 20. In addition, the control valve 18 is coupled to a solenoid 22 which is set up to be transferred into the three further positions 19*b*, 19*c* and 19*d* counter to the force of the restoring spring 20 of the control valve 18.

The control valve 18 has two input ports, namely a pressure medium port P for supplying the pressure medium and a tank port T for removing the pressure medium from a pressure medium circuit provided for the adjustment of the camshaft adjuster 2. In addition, the control valve 18 has three output ports, namely a first output 24, from which a line 26 leads to the late chambers A" of the pairs of chambers 4', a second output 28, which is connected to the early chambers B' of the pairs of chambers 4' via a line 29, and a third output. 30, from which the oil is conducted via a pressure line 32 to a locking mechanism (illustrated schematically by the block 34) of the camshaft adjuster 2.

The locking mechanism 34 comprises a pin (not shown specifically here) which, for locking the rotor in relation to the stator, engages axially in a slotted guide formed in a sealing cover which bears against the stator and the rotor. When the pressure line 32 is connected to the pressure medium port P, the pin is pressurized and pressed back, and therefore the pin cannot reach the slotted guide. If, however, the pin is no longer subjected to any pressure, it produces the form-fitting connection with the slotted guide as soon as the latter is positioned opposite the pin.

When the motor is switched off, the vanes 8 of the rotor are generally in a middle position which is indicated by the dashed line 36. In the middle position 36, the camshaft adjuster 2 is locked. If, when the motor is at a standstill, for example by the motor stalling, the angular position is between the middle position 36 and the late end stop S, the camshaft adjuster 2 cannot lock in the middle position 36 owing to the action of the moment of friction of the camshaft in the late direction during starting of the motor, but rather is displaced into the late end stop S.

In order to lock the camshaft adjuster 2 irrespective of the angular position of the rotor when the motor is switched off, a forced control is provided, the forced control comprising a positioning valve 38 which is connected only to one pair of chambers, which is referred to as the control chamber pair 4. All other pairs of chambers 4' are called "further pairs of chambers" in the remainder of the text. When the motor is switched off, i.e. when the control valve 18 is in the basic position 19*a*, the oil exchange of the control chamber pair 4 with the pressure medium circuit takes place via the positioning valve 38. In addition, grooves 40*a*, 40*b*, 40*c*, 40*d*, into which bores 42, 44 in the rotor open, are formed in the sealing cover. When the motor is turned off, the oil reaches the control chambers A, B or flows out therefrom via the bores 42, 44, the grooves 40*a*, 40*b*, 40*c*, 40*d* and the positioning valve 38.

In the exemplary embodiment according to FIG. 1 and FIG. 2, the positioning valve 38 is a 6/2-way directional control valve and has an ON and an OFF state. The positioning valve 38 is kept in the ON state by a spring 46 when no external forces are acting on the positioning valve 38.

The positioning valve 38 is connected to the pressure line 32 via a line 48, and therefore when oil is fed into the pressure line 32, said oil presses the positioning valve 38 into the OFF state counter to the force of the spring 46.

FIG. 1 shows the case in which, when the motor is switched off, the vanes 8 are located between the late end stop S and the middle position 36, and therefore, in order to lock the camshaft adjuster 2, said vanes have to be displaced to the right to the middle position 36, which is indicated by the arrows 50. In this case, the chambers 6 of the further pairs of chambers 4' are short-circuited via two inputs 52, 54 of the positioning means 38 such that the pressure in all of said chambers 6 is equalized. Oil is tapped off by the line 29, which supplies the late chambers B' with oil, and fed into the groove 40*a* via the bore 42. The groove 40*a* is connected to the positioning valve 38 via a supply line 56. In the ON position of the positioning valve 38, the oil finally flows into the late control chamber A, as a result of which the volume thereof is increased and the vane 8 is transferred further to the right in the direction of the arrow 50. At the same time, the early control chamber B is connected via the positioning valve 38 and via a removal line 58 to the groove 40*c*, from which the oil is removed via the bore 44 to a tank of the lubricant circuit, which is indicated by the symbol T. With the displacement of the vanes 8 to the right in FIG. 1, the bores 42 and 44 in the rotor are also displaced further to the right. When the vanes 8 have reached the middle position 36, the bores 42, 44 respectively overlap every two grooves 40*a*, 40*b* and 40*c*, 40*d*, as a result of which the camshaft adjuster is fully braked, and the pin of the locking mechanism 34 has more time for axial locking.

In the basic position of the control valve 18, neither the locking mechanism 34 nor the positioning valve 38 is pressurized. The positioning valve 38 is therefore in the ON position.

If, when the internal combustion engine is switched off, the camshaft adjuster 2 is in the middle position 36, the pin automatically latches into the slotted guide, and therefore the rotor is not adjusted at all in relation to the stator.

The principle of adjusting the rotor in the late direction as far as the middle position 36 is illustrated in FIG. 2. The substantial difference in comparison to FIG. 1 is that the position of the vanes 8 closer to the early end stop F causes the two bores 42, 44 to respectively overlap the grooves 40*b* and 40*d*. In this case, the groove 40*b* is connected to the tank of the lubricating circuit in order to remove the oil while oil is fed into the groove 40*d* via a line 60. The control chamber 13 which is smaller when the motor is turned off is therefore connected to the groove 40*d* via a supply line 62, and oil is introduced into the control chamber B. At the same time, oil is removed from the opposed control chamber A via the positioning valve 38 and a removal line 64 to the groove 40*d*. The oil flows out of the camshaft adjuster 2 from the groove 40*d*.

Figure 3:
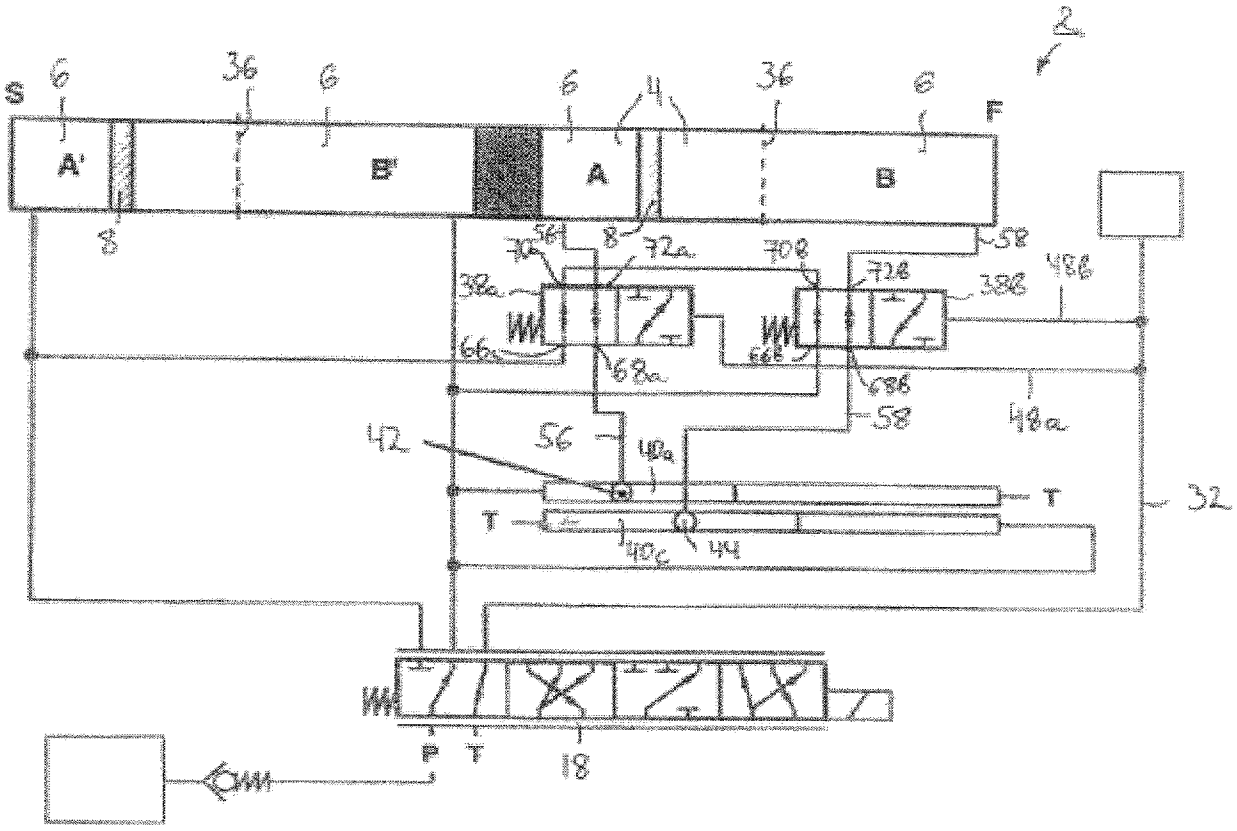
FIG. 3 shows the adjustment of a camshaft adjuster according to a second variant embodiment from "late" in the direction of "early" as far as the middle position.

FIG. 3 shows a second variant embodiment of a camshaft adjuster 2 which essentially differs from the first alternative according to FIG. 1 and FIG. 2 by the positioning valve 38 being in two parts. Two 4/2-way positioning valves 38*a*, 38*b* are provided to control the oil flow to the control chambers A and B. These positioning valves 38*a*, 38*b* each have four ports and can be transferred into two positions, an ON and an OFF position. The positioning valves 38*a*, 38*b* respectively have two inputs 66*a*, 68*a* and 66*b*, 68*b* and two outputs 70*a*, 72*a* and 70*b*, 72*b*. The positioning valves 38*a*, 38*b* are likewise pressure-controlled valves which are connected via respective lines 48*a*, 48*b* to the pressure line 32.

The vane 8 which separates the two control chambers 6*a* and 6*h* from each other is pressed in the early direction to the middle position 36 by the ON position (shown in FIG. 3) of the positioning valves 38*a*, 38*b*. For this purpose, the late control chamber A is connected to the groove 40*a* via the feed line 56. Oil is fed through the bore 42 into the groove 40*a*, said oil subsequently being fed to the late control chamber 6*a* via the feed line 56. Parallel thereto, the oil contained in the early control chamber B flows out of the camshaft adjuster 2 via the removal line 58, via the groove 40*c* and via the bore 44.

In order to equalize the pressure in the further chambers A' and B', said chambers A', B' are short-circuited to each other via the ports 66*a*, 70*a* and 66*b*, 70*b* of the two positioning valves 38*a*, 38*b*.

If the positioning valves 38*a*, 38*b* are pressurized by the oil in the pressure line 32, they are displaced to the left in FIG. 3 into the OFF position thereof, in which the control chamber A communicates in terms of flow with the further late chambers A' via the positioning valve 38*a*, and the early control chamber B communicates in terms of flow with the further early chambers B' via the positioning valve 38*b*.

LIST OF REFERENCES

2 Camshaft Adjuster
4 Control Chamber Pairing
4' Pairs of Chambers
6 Chamber
8 Vane
10 Web
12 Lubricating Oil Circuit
14 Lubricating Oil Line

16 Nonreturn Valve
18 Control Valve
19*a* Basic Position of the Control Valve
19*b* Position of the Control Valve
19*c* Position of the Control Valve
19*d* Position of the Control Valve
10 Restoring Spring
22 Solenoid
24 First Output of the Control Valve
26 Line
28 Second Output of the Control Valve
29 Line
30 Third Output of the Control Valve
32 Pressure Line
34 Locking Mechanism
36 Middle Position
38 Positioning Valve
38*a* First Positioning Valve
38*b* Second Positioning Valve
40*a, b, c, d* Grooves
42 Bore in the Rotor
44 Bore in the Rotor
46 Spring
48, 48*a, b* Line
50 Arrow
52 First Input of the Positioning Valve
54 Second Input of the Positioning Valve
56 Supply Line
58 Removal Line
60 Line
62 Supply Line
64 Removal Line
66*a*, 68*a* Port of the First Positioning Valve
70*a*, 72*a* Port of the First Positioning Valve
66*b*, 68*b* Port of the Second Positioning Valve
70*b*, 72*b* Port of the Second Positioning Valve
A Late Control Chamber
A' Late Chamber
B Early Control Chamber
B' Early Chamber
F Early End Stop
P Pressure Oil Port
S Late End Stop
T Tank Port

The invention claimed is:

1. A camshaft adjuster for an internal combustion engine having a crankshaft and a camshaft, the camshaft adjuster comprising:

a stator, which can be driven by the crankshaft and which is located radially externally;

a rotor, which can be connected to the camshaft for conjoint rotation and which is located radially internally;

pairs of chambers arranged between the rotor and the stator, each of the pairs of chambers comprising two opposing chambers, namely an early chamber and a late chamber, which can be acted upon with a pressure medium in such a manner that a rotational position of the rotor relative to the stator can be changed;

a pressure medium circuit having a control valve that regulates an inflow and an outflow of the pressure medium to and from the chambers and has a pressure medium port for supplying the pressure medium and a tank port for removing the pressure medium;

at least one pressure-controlled positioning valve connected to one of the pairs of chambers and designed such that, in an unenergized basic position of the control valve and in order to set a middle position:

the early chamber is connected to a supply line and the late chamber is connected to a removal line when the early chamber is smaller than the late chamber, and the late chamber is connected to the supply line and the early chamber is connected to the removal line when the late chamber is smaller than the early chamber; and at least one sealing cover having grooves, the sealing cover laterally delimits the chambers and bears against the stator and the rotor, the rotor has bores and the positioning valve communicates in terms of flow with the grooves formed in the sealing cover and can be connected to the pressure medium circuit via the bores in the rotor;

wherein, the pressure medium circuit has a tank and the grooves in the sealing cover include a first groove and a second groove and, in the basic position of the control valve, the smaller of the early chamber or the late chamber of the one of the pairs of chambers is connected via the positioning valve to the first groove in the sealing cover, the first groove is connected to the pressure medium port of the control valve, and the larger of the early chamber or the late chamber of the one of the pairs of chambers is connected via the positioning valve to the second groove in the sealing cover, the second groove returns the pressure medium into the tank of the pressure medium circuit.

2. The camshaft adjuster according to claim 1, further comprising a locking mechanism and a pressure line, the locking mechanism connects the rotor and the stator to each other for conjoint rotation in the middle position, and the control valve is connected to the locking mechanism via the pressure line.

3. The camshaft adjuster according to claim 2, wherein the pressure line is connected to the tank port of the control valve in the basic position of the control valve.

4. The camshaft adjuster according to claim 2, wherein the positioning valve is connected to the pressure line and has two positions which can be set depending on whether the pressure line is connected to the pressure medium port or to the tank port.

5. The camshaft adjuster according to claim 2, wherein the pairs of chambers includes a first pair of chambers and a second pair of chambers, and the chambers of the second pair of chambers are short-circuited in the basic position of the control valve.

6. The camshaft adjuster according to claim 5, further comprising a first port, a second port, a third port and a line that extends to the early chamber of the second pair of chambers, wherein the control valve is a 5/4-way directional control valve connected via the first port to the late chamber of the second pair of chambers, via the second port to the early chamber of the second pair of chambers and via the third port and the pressure line to the locking mechanism, and wherein the supply line is a branch of the line that extends to the early chamber of the second pair of chambers.

7. The camshaft adjuster according to claim 5, wherein the positioning valve is a 6/2-way directional control valve that communicates with the first pair of chambers via two ports.

8. The camshaft adjuster according to claim 5, wherein the positioning valve is of a two-part design and comprises two 4/2-way positioning valves, and wherein the first pair of chambers is connected to the supply line and the removal line via respective positioning valves in the basic position of the control valve.

9. A camshaft adjuster for an internal combustion engine having a crankshaft and a camshaft, the camshaft adjuster comprising:

a stator, which can be driven by the crankshaft and which is located radially externally;

a rotor, which can be connected to the camshaft for conjoint rotation and which is located radially internally;

pairs of chambers arranged between the rotor and the stator, each of the pairs of chambers comprising two opposing chambers, namely an early chamber and a late chamber, which can be acted upon with a pressure medium in such a manner that a rotational position of the rotor relative to the stator can be changed;

a pressure medium circuit having a control valve that regulates an inflow and an outflow of the pressure medium to and from the chambers and has a pressure medium port for supplying the pressure medium and a tank port for removing the pressure medium;

at least one pressure-controlled positioning valve connected to one of the pairs of chambers and designed such that, in an unenergized basic position of the control valve and in order to set a middle position:

the early chamber is connected to a supply line and the late chamber is connected to a removal line when the early chamber is smaller than the late chamber, and the late chamber is connected to the supply line and the early chamber is connected to the removal line when the late chamber is smaller than the early chamber;

a locking mechanism and a pressure line, the locking mechanism connects the rotor and the stator to each other for conjoint rotation in the middle position, and the control valve is connected to the locking mechanism via the pressure line, wherein the pairs of chambers includes a first pair of chambers and a second pair of chambers, and the chambers of the second pair of chambers are short-circuited in the basic position of the control valve; and a first port, a second port, a third port and a line that extends to the early chamber of the second pair of chambers, wherein the control valve is a 5/4-way directional control valve connected via the first port to the late chamber of the second pair of chambers, via the second port to the early chamber of the second pair of chambers and via the third port and the pressure line to the locking mechanism, and wherein the supply line is a branch of the line that extends to the early chamber of the second pair of chambers.

10. The camshaft adjuster according to claim 9, further comprising at least one sealing cover having grooves, the sealing cover laterally delimits the chambers and bears against the stator and the rotor, the rotor has bores and the positioning valve communicates in terms of flow with the grooves formed in the sealing cover and can be connected to the pressure medium circuit via the bores in the rotor.

11. The camshaft adjuster according to claim 10, wherein, the pressure medium circuit has a tank and the grooves in the sealing cover include a first groove and a second groove and, in the basic position of the control valve, the smaller of the early chamber or the late chamber of the one of the pairs of chambers is connected via the positioning valve to the first groove in the sealing cover, the first groove is connected to the pressure medium port of the control valve, and the larger of the early chamber or the late chamber of the one of the pairs of chambers is connected via the positioning valve to the second groove in the sealing cover, the second groove returns the pressure medium into the tank of the pressure medium circuit.

12. The camshaft adjuster according to claim 9, wherein the pressure line is connected to the tank port of the control valve in the basic position of the control valve.

13. The camshaft adjuster according to claim 9, wherein the positioning valve is connected to the pressure line and has two positions which can be set depending on whether the pressure line is connected to the pressure medium port or to the tank port.

14. The camshaft adjuster according to claim 9, wherein the positioning valve is a 6/2-way directional control valve that communicates with the first pair of chambers via two ports.

15. The camshaft adjuster according to claim 9, wherein the positioning valve is of a two-part design and comprises two 4/2-way positioning valves, and wherein the first pair of chambers is connected to the supply line and the removal line via respective positioning valves in the basic position of the control valve.

* * * * *